United States Patent [19]

Göddecke et al.

[11] 4,325,166

[45] Apr. 20, 1982

[54] METHOD OF MANUFACTURING A COLOR TELEVISION DISPLAY TUBE

[75] Inventors: Hubert Göddecke; Werner Reichardt; Kurt Schumacher, all of Aachen; Rainer Töpfer, Herzogenrath, all of Fed. Rep. of Germany

[73] Assignee: U.S. Philips Corporation, New York, N.Y.

[21] Appl. No.: 248,915

[22] Filed: Mar. 30, 1981

Related U.S. Application Data

[63] Continuation of Ser. No. 39,538, May 16, 1979, abandoned.

[30] Foreign Application Priority Data

May 22, 1978 [DE] Fed. Rep. of Germany ..... 2822345

[51] Int. Cl.[3] ..... H01J 9/18

[52] U.S. Cl. ..... 29/25.15

[58] Field of Search ..... 29/25.13, 25.15

[56] References Cited

U.S. PATENT DOCUMENTS

| | | | |
|---|---|---|---|
| 3,482,286 | 12/1969 | Fassett et al. | 29/25.13 |
| 3,672,014 | 6/1972 | Kimbrough | 29/25.15 |
| 3,701,185 | 10/1972 | Van Renssen | 29/25.15 |
| 3,701,193 | 10/1972 | Ragland, Jr. | 29/25.15 |
| 3,838,483 | 10/1974 | Baranski et al. | 29/25.13 |
| 4,058,875 | 11/1977 | Nubani et al. | 29/25.15 |

*Primary Examiner*—John McQuade

*Attorney, Agent, or Firm*—Robert J. Kraus

[57] ABSTRACT

A method is provided for positioning a supporting frame for a color television tube mask in a repeatedly obtainable rest position with respect to the face plate of the tube during various stages of the tube manufacture which require accurate positioning of the frame. Such stages include attachment of the mask to the frame to form a color selection electrode, connection to the frame of means for increasing the mechanical stability of the electrode, and repeated exposures and chemical treatments of color phosphors on the face plate. The method comprises applying a time-varying magnetic field to the frame until it is vibrated into an ultimate rest position relative to the face plate.

8 Claims, 6 Drawing Figures

METHOD OF MANUFACTURING A COLOR TELEVISION DISPLAY TUBE

This is a continuation of application Ser. No. 39,538, filed May 16, 1979, now abandoned.

BACKGROUND OF THE INVENTION

The invention relates to a method of manufacturing a color television display tube having a color selection electrode in which in at least one step of the method a supporting frame of the color selection electrode must be accurately positioned on at least three mandrels present in the face plate of the tube.

During the manufacture a color television display tube, one of the most critical steps is establishing the spacing between the color selection electrode and the face plate with very small tolerances.

The introduction of the so-called In-Line technique in which the three electron gun systems are arranged in one plane beside each other and luminescent strips having alternating colors are formed on the screen provided a certain relaxation of tolerances, because in the direction of the strips the tolerances for the landing point of the electron beam on the display screen could be slightly widened. However, in the direction of the raster scan lines the tolerances remained so that during tube manufacture, and especially during assembly of the color selection electrode, utmost care must be taken when positioning the color selection electrode with respect to the face plate.

With the increase in brightness introduced recently, the requirements on the landing accuracy of the electron beams on the associated luminescent strips were further increased. As a result of this, the permissible tolerances in the distance between the inner surface of the face plate and the outer surface of the mask sheet were further restricted, which necessitated an even higher accuracy of the position of the color selection electrode in the face plate.

During tube manufacture, several adjusting steps are performed to align the parts as accurately as possible with respect to each other. For example, in an early step of a known manufacturing process a supporting frame with holders connected thereto is inserted into the face plate. The holders typically include apertures which snap into engagement with corresponding mandrels provided in the face plate glass. This supporting frame is then welded to a pre-bent mask sheet which is positioned as accurately as possible. The sheet had been laid on a spacing jig, placed on the inner surface of the face plate, before the supporting frame was inserted. It has been found that the supporting frame was often not held correctly in the face plate during welding, because the holders had not been placed firmly on the mandrels. As a result the mask sheet would not be correctly positioned on the supporting frame, but would be welded in a slightly oblique position.

In a much later step of the tube manufacturing process, the finished color selection electrode, comprising the supporting frame and the mask sheet, is inserted into the face plate and the holders are snapped into engagement with the mandrels. An additional holder is then snapped onto a respective face plate mandrel and this holder is also welded to the supporting frame. This additional holder increases color selection electrode's mechanical stability. During the welding of the additional holder it is also necessary for the color selection electrode and its already-connected holders to be correctly positioned on the mandrels. It is known that when the mandrels are slightly rough, the holders will not slide correctly on the mandrels. The suggestion has been made to polish the mandrels and to punch the corresponding apertures in the holders so as to be slightly conical to provide a better sliding surface. However, such steps are very expensive in production line operations.

It has also been established that during flow coating when the individual exposures are made for the red, green and blue phosphors, the snapping of the color selection electrode onto the mandrels in the face plate does not occur sufficiently accurately. Differences for each individual exposure operator occur.

Also during the final positioning of the color selection electrode in the face plate before assembling the tube, special care is necessary. This last step determines how accurately the electron beam of a gun will land on its associated luminescent strips in the finished tube. Although errors in electrode positioning cause beam deviations which are hardly noticeable in the center of a display screen, considerable deviations are visible in the proximity of the corners.

From the prior art, jolting tables are known for finding defective contacts during the manufacture of electronic circuits, and jolting transporters are known for use during the manufacture of electronic components for transport. In the manufacture of color television display tubes, jolting of the tube envelope is also known for shaking loose particles out of the mask area so they do not disturb the displayed picture. Typically loose particles such as welding spatters, glass splinters and organic substances occur. These cause clear shadows or color defects on the display screen during operation of the color television display tube if they are located in front of the slots in the color selection electrode.

Tubes having color purity defects caused by improper frame positioning during manufacture can be corrected afterward only with difficulty.

SUMMARY OF THE INVENTION

Thus it is an object of the invention to introduce suitable steps in the method of manufacturing a color television display tube to achieve a better frame positioning accuracy.

In order to solve this problem, according to the invention, in a method of manufacturing a color television display tube of the kind mentioned in the opening paragraph, an alternating magnetic field is applied in such manner that the parts moved thereby are accurately moved into their desired positions. The alternating magnetic field causes jolting of the parts. As a result of such jolting, the parts each reach a defined final position which can be reliably obtained during subsequent steps of the tube manufacture. Thus the positioning of the parts during manufacture became independent of the operator and smaller tolerances are possible.

A method according to the invention is characterized in that positioning of the supporting frame with its holders in the face plate and positioning of the mask sheet with respect to the supporting frame, during the manufacture of the color selection electrode, is effected by the use of one or more electromagnets which can be actuated with alternating current. These electromagnets are arranged outside the face plate, in the middle of the sides of the supporting frame in such manner that the jolting magnetic field generated thereby moves the parts into their ultimate position in approximately 5 seconds.

A further method according to the invention comprises positioning the color selection electrode before the connection of the additional holder. Two electromagnets which can be actuated by alternating current are placed in the proximity of the corners of the supporting frame which are adjacent to the connecting point of the holder. The electromagnets are arranged outside the upright edge of the face plate in such manner that the jolting field generated thereby moves the parts into their ultimate positions in approximately 5 seconds.

Finally, a method according to the invention is characterized in that positioning of the color selection electrode before the individual exposures in the flow coating process is effected by the use of two electromagnets which can be actuated with alternating current. These electromagnets are advantageously placed in the proximity of the corners of the supporting frame in such a manner that the magnetic jolting field generated by the electromagnets moves the parts into their ultimate position in approximately 5 seconds. Alternatively, at least two electromagnets may be provided on the spherical side of the face plate in the area above the supporting frame.

The electromagnets are preferable energized with alternating current of approximately 50 Hz.

When using the invention, the distance between the mask sheet and the face plate inner surface can be maintained with a tolerence of 0.01 to 0.02 mm. This is an improvement, as compared with manual positioning during welding of the additional holder, of up to 20 μm.

DESCRIPTION OF THE PREFERRED EMBODIMENTS

Figure 1:
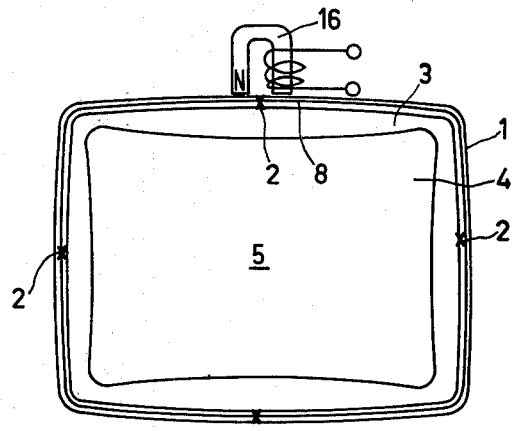
FIG. 1 is a plan view of a face plate with inserted color selection electrode and an electromagnet on its long side.

Reference numeral 1 in the Figures denotes the upright edge of the face plate of a color television display tube. Referring to FIG. 1, reference numerals 2 denote the suspension points for a supporting frame 3 and mask sheet 4 which collectively form a color selection electrode 5. During assembly of the color selection electrode three supporting frame holders are snapped into engagement at 2 and an electromagnet 16 is switched on in order that the inserted supporting frame with its holders, and the mask sheet, find their correct positions. It exerts a pulling force on the supporting frame via the magnetic field. The field lines of the electromagnet 16 emanate approximately perpendicularly from the poles denoted by N and S, as shown at 8, then extend along the supporting frame and close in said frame. When the electromagnet 16 is connected to an alternating line current oscillating at 50 Hz, a vibration of the supporting frame at 100 Hz occurs and the supporting frame is jolted with its holders on face plate mandrels without the interference of an operator, the ultimate position being achieved after approximately 5 seconds. Simultaneously the mask sheet 4 is jolted into its force-free rest position. Only then is the mask sheet welded to the supporting frame. Automatic welding occurs at 14 (FIG. 2) along the circumferences of the mask sheet and the supporting frame, where the bent edge 13 of the mask sheet overlaps the adjacent edge 12 of the supporting frame.

Figure 2:
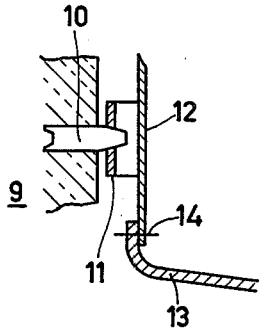
FIG. 2 is a sectional view of critical suspension elements, namely a holder of the color selection electrode, a mandrel, and a welding connection attaching the mask sheet to the supporting frame.

FIG. 2 also shows one of the holders 11, a part of the upright edge of the face plate 9 and a metallic mandrel 10 which is molded in the glass and on which the holder 11 bears. Said holder is welded to the supporting frame edge 12 of the color selection electrode and at one end has an aperture which is placed over a conical part of the mandrel. The color selection electrode always remains detachable from the face plate because it is held only by the resilience of the holder 11.

The supporting frame 12 may have a thicker wall than the mask sheet. This is necessary for so-called frameless masks. In such case, it is common to provide the mask sheet 13 with reinforcements and hence produce a mask sheet edge 13 having the same thickness as the frame edge 12, which is favorable from a thermal point of view.

Before the welding of the connections at 14 (up to 10 spotwelds are made along the circumferences for a 67 cm color television display tube) the supporting frame edge 12 with its holder 11 must be positioned on the mandrel 10 in its ultimate rest position. The mask sheet edge 13 must also be accurately positioned on the supporting frame edge 12. To effect correct positioning of the holder with respect to the mandrel and of the mask sheet with respect to the supporting frame, the electromagnet 16 is energized causing a 100 Hz vibration lasting approximately 5 seconds. After this vibration, the parts of the color selection electrode have reached their ultimate rest positions and the welding may be carried out.

Figure 3:
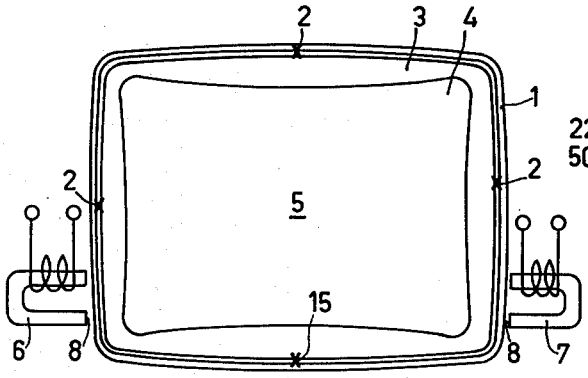
FIG. 3 is a plan view of a face plate with inserted color selection electrode and two electromagnets on the two narrow sides.

FIG. 3 shows a similar electromagnet arrangement used for fixing a fourth suspension point 14. In this step of the tube manufacture, the assembled color selection electrode 5 is snapped into engagement with the face plate 1 at the three places denoted by 2. Only the fourth point at 15 is free. The electromagnets 6 and 7 are then switched on vibrating the color selection electrode with respect to the fixed glass and an ultimate rest position of the electrode is achieved after approximately 5 seconds. The operator can then weld the additional fourth holder for connection to the fourth point, so that the last point for the connection of the color selection electrode in the assembled face plate is also fixed.

Figure 4:
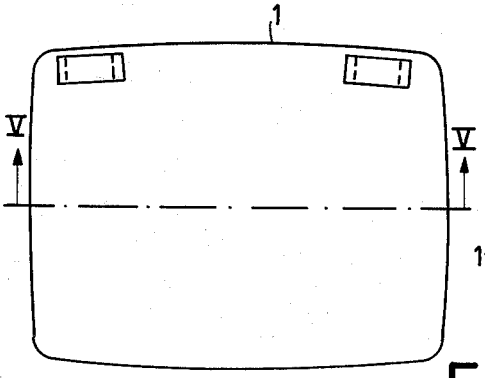
FIG. 4 is a plan view of the face plate with two inserted electromagnets in the spherical area.
Figure 5:
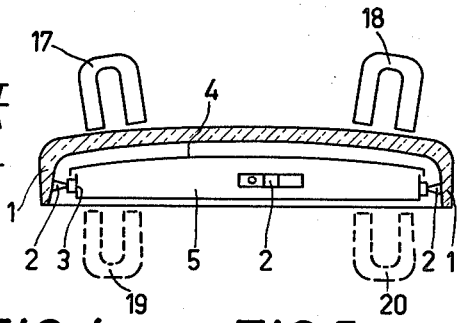
FIG. 5 is a side elevation of FIG. 4, partly in cross-section, with two alternatives for the placement of the electromagnets.

FIG. 4 shows a further electromagnet arrangement used during the flow-coating process when the display screen is laid on the inside. During this flow-coating process, three exposure steps are carried out, as is known, because the exposing light source must successively assume different positions for providing the red, green and blue colors. Because chemical treatments involving phosphor suspensions and water must be used, the color selection electrode 5 must be removed from the face plate during each treatment. It is repeatedly removed from the face plate and snapped into engagement during the exposure steps. Considerable differences in the position of the color selection electrode arise during such repeated replacement in the face plate. According to the invention two electromagnets are provided on either the spherical part of the face plate or the back of the electrode, as is shown in FIGS. 4 and 5, respectively, such that the fields of said magnets impinge perpendicularly on the electrode and close in it. When the electromagnets are energized, a vibration occurs which is sufficient to move the holders to their rest positions.

Figure 6:
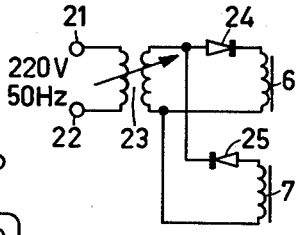
FIG. 6 is an example of a circuit arrangement for energizing two electromagnets.

FIG. 6 shows an example of a circuit arrangement which can be utilized to energize the electromagnets. An alternating current of 220 V/50 Hz can be applied to the terminals 21 and 22. An isolating transformer 23 has outputs which are electrically-connected to the electromagnets 6 and 7 via rectifiers 24 and 25. Thus the electromagnets are energized by opposite phases and attract the mask sheet and the supporting frame at 50 Hz causing these parts to vibrate and move to their correct position.

What is claimed is:

1. A method of positioning a supporting frame for a color television tube mask in a repeatedly obtainable rest position with respect to the face plate of the tube to facilitate a tube manufacturing process requiring such positioning, said method comprising the steps of:

A. attaching the supporting frame to the face plate by engaging holders provided on the frame with respective frame-locating members provided on the face plate; and B. applying a time-varying electromagnetic field to the frame until said holders and their respective frame locating members are vibrated into ultimate rest positions relative to each other.

2. A method as in claim 1 which is utilized to facilitate attachment of the mask to the supporting frame, said method further comprising the steps of:

A. placing the mask in its approximate rest position in the face plate before attaching the supporting frame to the face plate;

B. applying the time-varying magnetic field to the mask until it is vibrated into an ultimate rest position relative to the face plate; and C. attaching the mask to the supporting frame.

3. A method as in claim 2 where the time-varying magnetic field is produced by an electromagnet placed adjacent a side wall of the face plate.

4. A method as in claim 1 which is utilized to facilitate the connection of an additional holder to the supporting frame, said method further comprising the steps of:

A. engaging the additional holder with a respective frame-locating member provided on the face plate; and B. connecting the additional holder to the supporting frame after applying the time-varying electromagnetic field;

said field being applied by electromagnets placed adjacent the face plate on opposite sides of the additional holder.

5. A method as in claim 1 where the mask is already attached to the supporting frame and where the method is utilized to facilitate successive exposures and chemical treatment of color phosphors on the face plate, said exposures being made through apertures in said mask.

6. A method as in claim 5 where the time-varying electromagnetic field is produced by electromagnets placed adjacent the face plate and arranged such that the field impinges perpendicularly on the mask.

7. A method as in claim 5 where the time-varying electromagnetic field is produced by electromagnets placed adjacent the supporting frame and arranged such that the field impinges perpendicularly on the mask.

8. A method as in claim 3, 4, 6 or 7 where said electromagnets are energized by a 50 Herz alternating current to produce the time-varying magnetic field.

* * * * *